United States Patent [19]

Ish, III

[11] Patent Number: 4,986,538

[45] Date of Patent: Jan. 22, 1991

[54] MULTI-STATION EXERCISE MACHINE WITH MULTI-EXERCISE PRESS STATION

[75] Inventor: Arthur B. Ish, III, Redmond, Wash.

[73] Assignee: Vectra Fitness, Inc., Redmond, Wash.

[21] Appl. No.: 398,787

[22] Filed: Aug. 25, 1989

[51] Int. Cl.[5] ..... A63B 21/00

[52] U.S. Cl. ..... 272/134; 272/117; 272/118

[58] Field of Search ..... 272/117, 118, 130, 134, 272/144, DIG. 4, 123

[56] References Cited

U.S. PATENT DOCUMENTS 3,917,262 11/1975 Salkeld ..... 272/118
4,336,934 6/1982 Hanagan et al. ..... 272/117 X
4,634,127 1/1987 Rockwell ..... 272/134

FOREIGN PATENT DOCUMENTS 8602848 5/1986 World Int. Prop. O. ..... 272/134

OTHER PUBLICATIONS

Advertisement for the "Pulldown Latissimus Machine", In Recreation, Sports and Leisure, p. 14, 9/1982.

*Primary Examiner*—Robert Bahr
*Attorney, Agent, or Firm*—Seed and Berry

[57] ABSTRACT

An exercise machine has multiple exercise stations including a press station at which exercises are performed in opposition to a selected amount of weight in a weight stack. The press station includes a swing link unit pivotally mounted at a fixed swing axis and providing a variable swing axis for a swing frame to be manipulated by the exercising person in press exercises. Movement of the swing frame is resisted by a cable loaded by the weight stack and connected to a lever portion of the swing frame. Provision is made for limiting downward swing of the swing link unit to fix the location of the swing axis when shoulder press exercises are to be performed, and for limiting swing of the swing frame toward the swing link unit when incline press exercises are to be performed. Incline press exercises and abdominal exercises can be performed when the swing frame is manipulated intermediate the positions used for performing incline press and shoulder press exercises.

20 Claims, 4 Drawing Sheets

FIG. 7
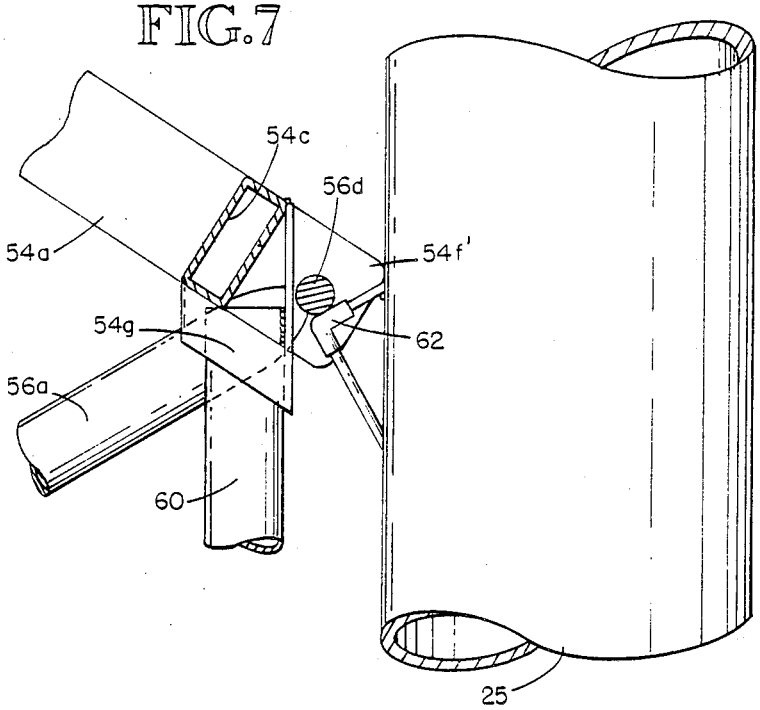
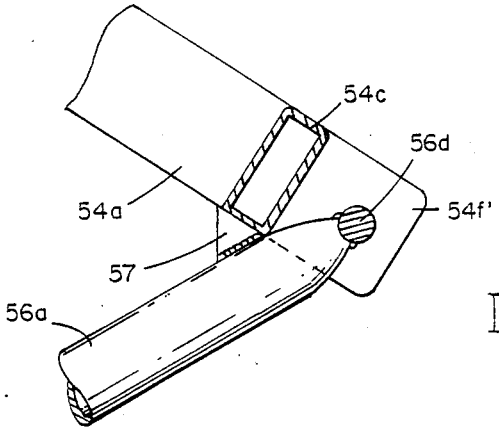
FIG. 8

MULTI-STATION EXERCISE MACHINE WITH MULTI-EXERCISE PRESS STATION

DESCRIPTION

The present invention relates to exercise machines having multiple exercise units of the type which operate via a cable and pulley system in opposition to a single set of weights, and which do not require cable connecting and disconnecting to shift activity from one exercise unit to another. The invention also relates to exercise machines including a press station at which a variety of press exercises can be performed.

U.S. Pat. No. 4,809,972 discloses an exercise machine with multiple exercise units each of which is connected to a respective one of multiple cables in a cable and pulley system connected to a weight stack. Each of the cables is tensioned when one of the exercise units is used, and each cable which is connected to an exercise unit has a stop adjacent the corresponding exercise unit to resist retraction of the cable when such unit is not in use. The exercise machine includes a press exercise unit providing a swing frame arranged to be swung upwardly about a fixed pivot in opposition to the weight stack responsive to an upward shoulder press normally performed with the exercising person reclined on a bench beneath the swing frame.

Instead of using a swing frame with a fixed pivot for a press exercise, the present invention utilizes a floating swing frame positioned to be operated from a semi-recumbent body support position, making it possible to perform decline, incline, chest and shoulder presses. The pivot axis of the swing frame is located at the rear of a swing link unit which is pivotally mounted at its forward end at a lower elevation. The swing frame has a lever extension connected to one end of a weight-loaded cable.

Forward swinging of the swing frame relative to the swing link unit is limited for performing decline press exercises in which the forward pivot of the swing link unit is the only pivot in use. Downward swinging of the swing link unit is limited for performing shoulder press exercises in which the pivot of the swing frame on the swing link unit is the only pivot in use. Incline press and chest press exercises are performed in an intermediate swinging range of the swing frame and swing link unit in which the forward pivot of the swing link unit and the pivot of the swing frame on the swing link unit are both in use. A detachable transverse bar is provided on the swing frame for chest engagement when abdominal exercises are to be performed.

The body support used for the press exercises is also used when performing leg curl exercises with apparatus connected at the other end of the weight-loaded cable.

In the accompanying drawings:

FIG. 7 is a detail vertical sectional view taken as indicated by line 7—7 in FIG. 3; and FIG. 8 is a detail vertical sectional view showing the stop in engagement between the swing frame and swing link unit.

Figure 1:
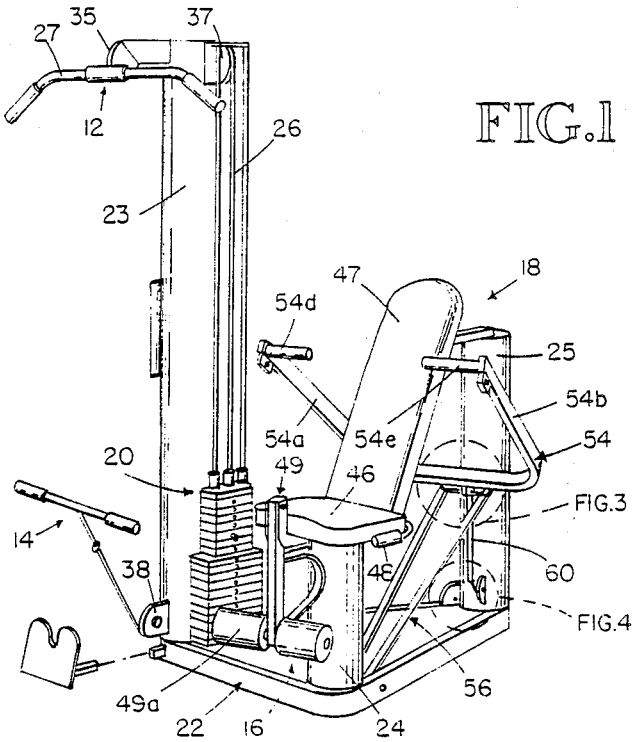
FIG. 1 is a perspective view of an exercise machine embodying the present invention.

Referring to the drawings, it is seen that for purposes of example the present invention is incorporated in an exercise machine with multiple exercise stations comprising a high pull station 12, a low pull station 14, a leg curl and extension station 16, and a press station 18, operating in conjunction with a weight stack unit 20 of standard construction. The present invention relates principally to the press station 18.

Figure 6:
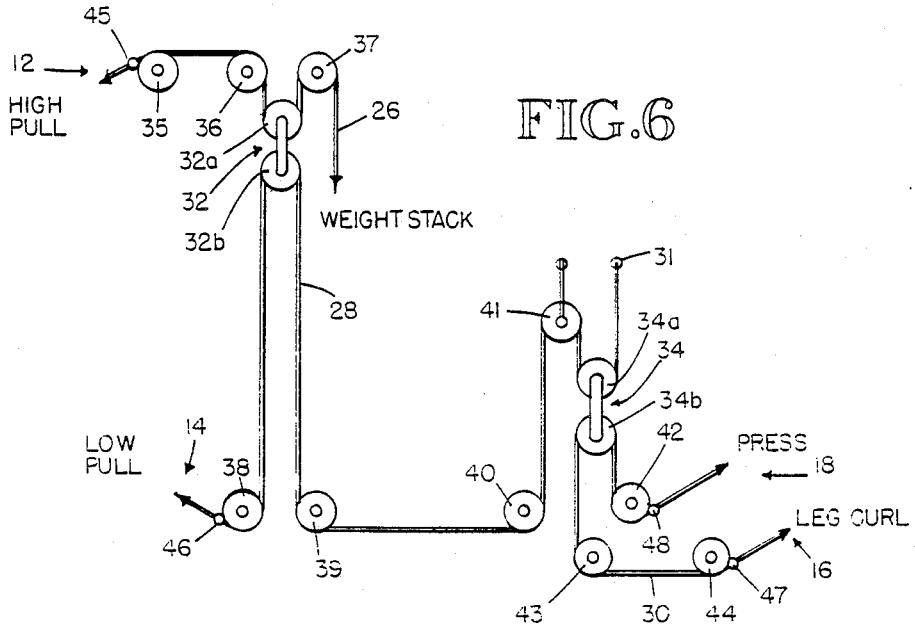
FIG. 6 is a schematic of the cable and pulley system for loading the exercise stations with the weight stack.

The exercise machine is supported on a generally triangular base 22 having tubular pedestals 23, 24 and 25 mounted at its vertices. As indicated schematically in FIG. 6, weights in the weight stack resist exercise motions at the exercise stations by means of (a) a cable 26 connected to a pick-up rod extending through the weights of the weight stack 20, and to a handle bar 27 at the high pull station, (b) a second cable 28 connected at its ends to a grip 29 at the low pull station 14 and a stop 31, and (c) a third cable 30 connected at its ends to the leg curl and extension station 16 and the press station 18. Cables 26 and 28 are operatively associated via a floating pulley unit 32 in pedestal 23, cables 28 and 30 are operatively associated via a second floating pulley unit 34 in pedestal 25. Cable 26 trains over pulleys 35, 36 and 37 supported at the top of pedestal 23, and under the upper pulley **32*a* of floating pulley unit 32 between pulleys 36 and 37**.

Cable 28 trains around pulley 38 at the base of pedestal 23, over the lower pulley **32*b* of floating pulley unit 32, around pulleys 39, 40 at the bases of pedestals 23 and 25, respectively, and then over an adjustable pulley 41 in the top of pedestal 25 and beneath the upper pulley 34*a* of floating pulley unit 34 before dead ending at 31 at the top of column 25. The third cable 30 connects between the stations 18, 16 via a pulley 42 at the base of pedestal 25, the lower pulley 34*b* of floating pulley unit 34, and lower pulleys 43 and 44 at the lower ends of pedestals 25 and 24**, respectively.

Stops 45, 46, 47 and 48 are mounted on cables 26, 28 and 30 at the exercise stations 12, 14, 16, and 18, respectively, to prevent retraction of the cables when one of the exercise stations is being used. The result is that the weight stack 20 loads each of the exercise stations. The amount of load is selected by engaging a lock pin through the appropriate one of the weights into the pick-up rod. Such a system is present in the exercise machine disclosed in U.S. Pat. No. 4,809,972. This patent also discloses a leg curl and extension station operating in the manner of the station 16. This station includes a seat 46 supported on the pedestal 24 and having a semi-reclined back support 47. The seat 46 has side handles 48 and may be pivoted upwardly at the front at pivot **46*a*. A dual-purpose element 49 of inverted T-shape having padded bottom arms 49*a* is pivotally mounted at 50 from a pivot support 51. The cable 30 connects to an arched cable guide member 52 at the back of the element 49 so that forward swinging movement of the latter is resisted by the load on the cable 30**.

For the leg curl exercise, the exerciser sits on the seat 46 and swings the element 49 forwardly by leg engagement with the arms **49*a*. For the leg extension exercise, the exerciser stands on the floor facing rearwardly and grabs the handles 48 with the seat 46 swung upwardly at the front. The arms 48***a* are then engaged by the back of the respective legs and swung forwardly by backward movement of the leg.

The seat and back 46, 47 are also used as a body support for a person exercising at the press station 18 which will now be described. The press station 18 provides a swing assembly which includes an upper generally U-shaped swing frame 54 and a lower swing link unit 56 having a pair of swing links 56*a*, 56*b* connected together at their ends by front and back pivot pins 56*c*, 56*d* which project laterally beyond the links for receiving bearings provided by the base 22 and ears 54*f*, 54*f'* to the back of a central element 54*c* of the swing frame 54. The latter also has a pair of transversely spaced arms 54*a*, 54*b* with opposed handle grips 54*d*, 54*e* at their forward ends. The pivot pin 56*d* defines an articulation axis for the swing assembly 54, 56.

Figure 2:
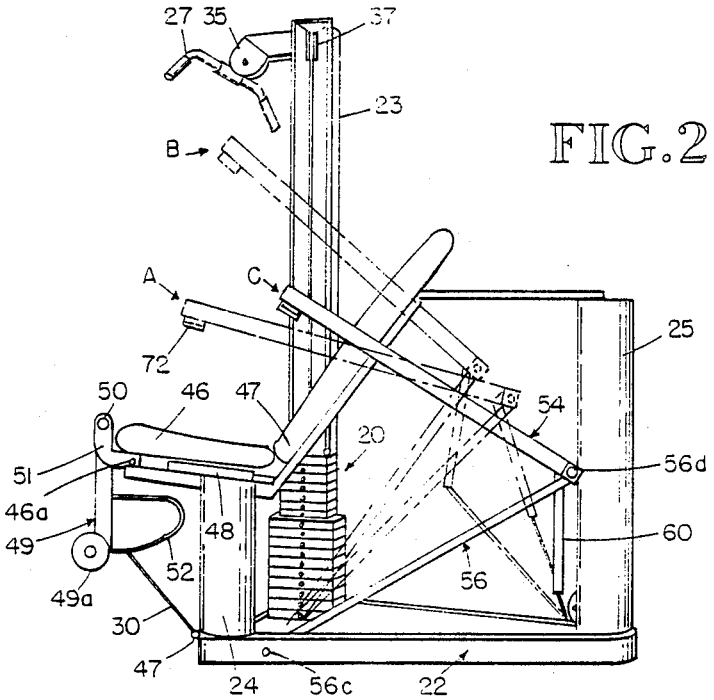
FIG. 2 is a side elevational view illustrating various press exercise positions of the press exercise station.
Figure 3:
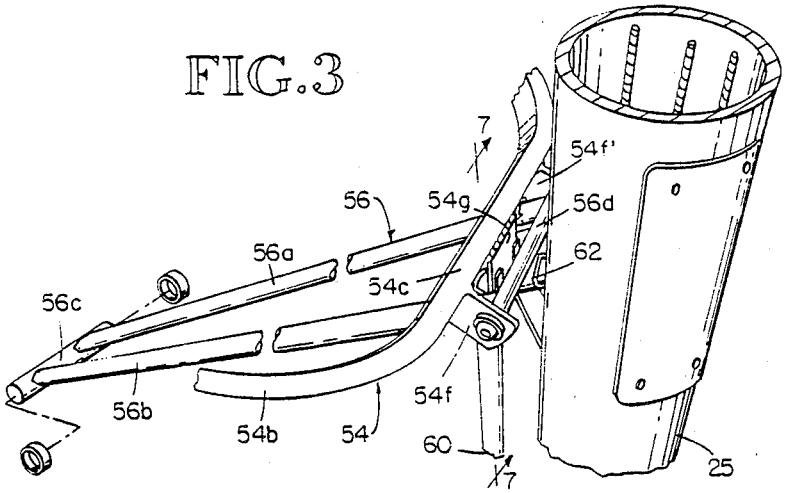
FIG. 3 is a detail perspective view taken as indicated in FIG. 1 and showing the press exercise assembly in the shoulder press position.
Figure 4:
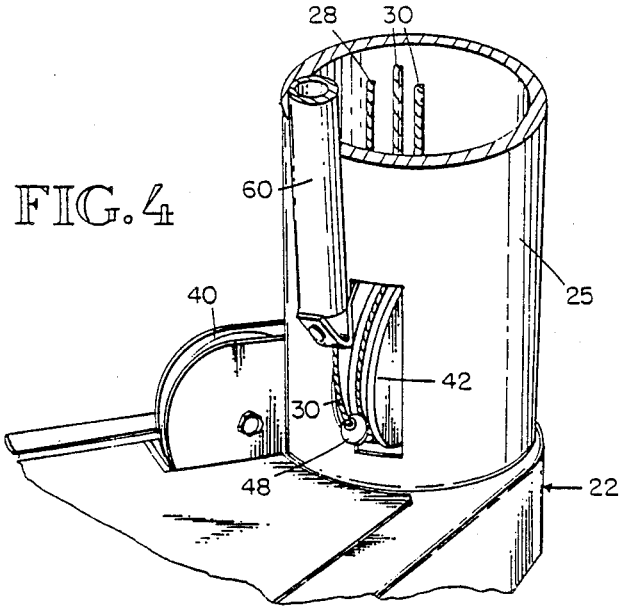
FIG. 4 is a detail perspective view taken as indicated in FIG. 1.

Extending downwardly from the swing frame 54 by way of a rigid connection to the central element 54*c* at a bracket 54*g*, is a leg extension 60 functioning as a leveraging arm. The cable 30 is connected to the lower end of this leg. The arrangement is such that the swing frame 54 can swing downwardly relative to the swing link unit 56 a limited amount before the lower edge of the central element 54*c* engages the upper surface of the swing link unit 56 at a stop 57 (FIG. 8) whereat the swing frame 54 is at an acute angle of about 60 degrees with the swing links. When the swing frame 54 and swing link unit 56 are in such engagement (position A in FIG. 2) they are in position for the performance of incline press exercises. A stop 62 is mounted at the front of the pedestal 25 for engagement by the pin 56*d* during downward swinging of the swing link unit 56 so as to limit downward swinging thereof (position C in FIG. 2) to thereby fix in space the location of the articulation axis between the swing frame 54 and the swing link unit 56 so that a shoulder press exercise can be performed during which only the swing frame 54 is manipulated.

In the central range of swinging motion of the swing frame 54 in which the swing link unit 56 remain unrestricted by the rear stop 62 and the swing frame 54 is not in engagement with the swing link unit 56 for incline press exercises (see position B in FIG. 2), the pivot 56*d* is free to swing and the swing frame 54 is free to move in a compound swinging motion for intermediate exercises such as an incline press in opposition to the loaded cable 30 acting on the leg 60. The pull line of the cable 30 between the leg 60 and the pulley 42 varies in length and angle relative to the horizontal as the swing frame 54 swings relative to the swing link unit 56 and the swing link unit swings relative to the base 22 during intermediate exercises. As a result of the described geometry the press stroke during the intermediate exercises is unrestrained in the sense that there is not a fixed swing axis for the swing frame 54. This makes possible a more complete workout because additional supportive musculature is put to use.

Figure 5:
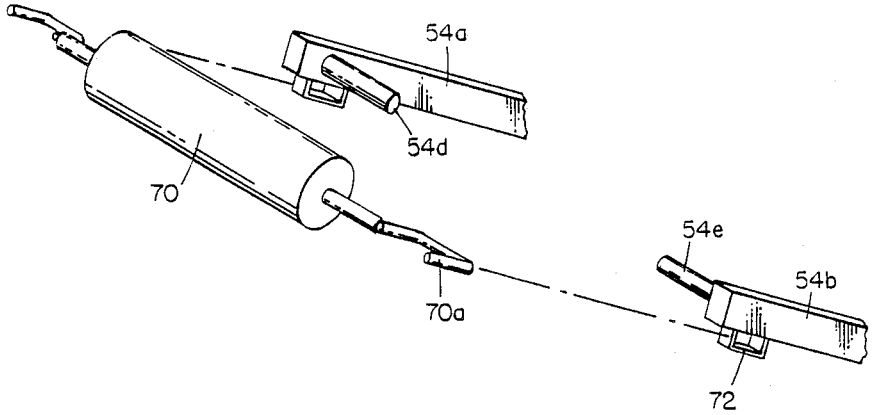
FIG. 5 is a perspective exploded view showing the transverse bar and its manner of attachment used when performing abdominal exercises.

For performing an abdominal exercise there is provided a detachable padded chest bar 70 for bridging between the outer ends of the arms 54*a*, 54*b* of the swing frame 54. As shown in FIG. 5, the chest bar 70 has a pair of U-hooks 70*a* at its ends arranged to interfit with eyes 72 at the underside of the swing frame arms adjacent the handles 54*d*, 54*e*.

The exerciser normally assumes a semi-recumbent position resting on the seat 46 and semi-reclined back 47 while performing the decline press, incline press, and shoulder press exercise by arm movements. During the abdominal exercise the exerciser is seated on the seat 46 and moves his(her) upper body forwardly away from the back 47 while engaging the chest bar 70.

The geometry for the press station is preferably selected so that when incline press exercises are performed the resultant of the force exerted via the cable and pulley system at the weight stack 20 at the press exercise station 18 is aligned within a ten percent tolerance with the direction of the force exerted by the exerciser on the swing frame.

A typical press station can have swing links with a length of about 42 inches between its forward pivot 56*c* and the articulation axis defined by the pivot pin 56*d*, a swing frame 54 with a length of about 41 inches from the handle grips 54*d*, 54*e* to the pin 56*d*, an included angle of about 120 degrees between the plane of the swing frame 54 and the leg 60, a leg length of about 14 inches to the connection with cable 30, a horizontal distance of about 42 inches between the forward pivot 56*c* and the rotary axis of the pulley 42, and a vertical distance of about 16 inches from the stop 62 to the rotary axis of the pulley 42. These dimensions are by way of example, and are not intended as a limitation.

In the illustrated embodiment the swing axis 56*d* for the swing frame 54 swings on an arc centered at front pivot 56*c* for the swing link unit 56. It will be appreciated that the travel path for the swing axis 56*d* can also be defined by roller tracks rather than using the swing frame unit 56, in which case the swing frame unit would have follower rollers mounted thereon at the swing axis 56*d*.

It will be appreciated that, although specific embodiments of the invention have been described herein for purposes of illustration, various modifications may be made without departing from the spirit and scope of the invention. Accordingly, the invention is not limited except as by the appended claims.

I claim:

1. An exercise station comprising;

a support frame;

an exercise station;

a swing frame at said exercise station carried by said support frame, said swing frame having handles and a swing axis which is free to move on a predetermined travel path;

means defining said travel path; and biasing means carried by said support frame and connected to said swing frame at a leveraging location spaced from said swing axis for resisting swinging movement of said swing frame relative to said swing axis and for also resisting movement of said swing axis along said travel path when press exercises are performed by a person gripping said handles at said exercise station.

2. An exercise machine according to claim 1 in which said travel path is an arc.

3. An exercise machine according to claim 1 in which stop means is provided for limiting movement of said swing axis away from said exercise station.

4. An exercise machine according to claim 1 in which said swing axis is located at one end of a swing link unit having its other end pivotally mounted on a fixed pivot axis parallel to said swing axis for defining said travel path.

5. An exercise machine according to claim 4 in which stop means is provided for limiting movement of said swing link unit.

6. An exercise machine according to claim 4 in which swinging motion of said swing frame toward said swing link unit about said swing axis in opposition to said biasing means is limited at an acute angle between said swing frame and said swing link unit.

7. An exercise machine according to claim 1 in which a chest bar is detachably connected to said handles.

8. An exercise machine according to claim 1 in which said biasing means comprises a cable connected at one of its ends to said swing frame at said leveraging location and a weight connected to the other end of said cable.

9. An exercise machine comprising:

a press station having a body support with forward and rear ends and lateral sides;

a swing assembly pivotally mounted at a forward pivot axis extending transversely beneath said body support, said swing assembly being centrally articulated at an articulation axis extending transversely behind said body support at a level elevated with respect to said forward swing axis;

said swing assembly including an upper swing frame swingably mounted at said articulation axis and presenting a pair of transversely spaced arms with handle grips located at opposite sides of said body support;

and biasing means connected to said swing frame beneath the level of said articulation axis and extending downwardly and rearwardly for urging said swing assembly to swing downwardly at said pivot axis, and for also urging said arms to swing at said articulation axis, in opposition to press exercises performed by an exercising person supported by said body support who is gripping said handles and pushing upwardly thereon.

10. An exercise machine according to claim 9 in which said body support comprises a seat with a semi-inclined back rest at its rear end.

11. An exercise machine according to claim 9 in which said swing assembly includes a lower swing link extending between said pivot axis and articulation axis, and an articulation stop at said articulation axis for limiting forward articulation of said swing assembly to a preset acute included angle between said swing link and swing frame whereby a decline press exercise may be performed when said articulation stop is engaged.

12. An exercise machine according to claim 9 in which said swing assembly includes a lower swing link extending between said swing axis and articulation axis; and a fixed shoulder press stop located behind said press station and swing axis and positioned at an elevation higher than that of said swing axis, said shoulder press stop being arranged to be engaged by said swing assembly for keeping the swing link substantially stationary so as to then permit said swing frame to be swung upwardly with said swing link stationary while an exercising person on said body support is performing a shoulder press exercise in opposition to said biasing means.

13. An exercise machine according to claim 9 in which said swing frame has a lever arm extending therefrom to a level normally below that of said articulation axis, and said biasing means comprises a loaded cable connected to a lower end portion of said lever arm.

14. An exercise machine according to claim 13 in which said cable engages a pulley at a location below and behind said lever arm, and a weight loads said cable.

15. An exercise machine according to claim 9 in which said swing assembly has a detachable chest bar bridging said arms adjacent said handle grips for engagement by the chest of an exercising person supported by said body support and performing a chest press exercise.

16. An exercise machine comprising:

a frame assembly providing a base;

a press station on the frame assembly having forward and rearward ends, a weight supported by said base;

a generally U-shaped swing frame having a movable swing axis, said swing frame presenting a pair of arms with front hand grips and a leg rigidly connected to said arms adjacent said swing axis and extending at an obtuse angle relative thereto;

guide means for defining a travel path for said swing axis; and a cable and pulley system connected to said weight and including a pulley mounted on said swing frame behind said press station and adjacent said base, and including a cable trained over said pulley and connected at one of its ends to said leg, said system being adapted to cause said weight to be lifted when said cable is pulled responsive to movement of said leg.

17. An exercise machine according to claim 16 in which said guide means comprises a swing link unit pivotally mounted on said frame assembly at a pivot axis, and to said swing frame at said swing axis, and in which there is a decline press stop on said swing assembly arranged when engaged to limit forward and downward swinging movement of said swing frame relative to said swing link unit about said swing axis at a position whereat the included angle between said swing frame and swing link unit is a preset acute angle, whereby further forward swinging movement of said swing frame is solely about said pivot axis for performing a decline press exercise when said decline press stop is engaged.

18. An exercise station according to claim 16 in which there is a shoulder press stop on said frame assembly at a position elevated above said base, said shoulder press stop being arranged to be engaged by said swing assembly so as to keep said swing axis stationary whereby said swing frame can then be swung upwardly about said stationary swing axis resisted by said weight-loaded cable acting on said leg for performing a shoulder press exercise.

19. An exercise machine according to claim 16 in which said press station includes a seat assembly, and leg curl exercise means is pivotally connected to said seat assembly, said cable being connected at the other of its ends to said leg curl exercise means.

20. An exercise machine according to claim 19 in which said cable and pulley system includes a floating pulley engaged by said cable, and said cable has stops at said press station and leg curl exercise means.

* * * * *